US005149851A

United States Patent [19]

Stout et al.

[11] Patent Number: 5,149,851

[45] Date of Patent: Sep. 22, 1992

[54] PROCESS FOR PREPARING TRIGLYCERIDES CONTAINING POLYUNSATURATED FATTY ACID MOIETIES

[75] Inventors: Virginia F. Stout; Erich J. Gauglitz, Jr.; William B. Nilsson, all of Seattle, Wash.

[73] Assignee: The United States of America as represented by the Secretary of Commerce, Washington, D.C.

[21] Appl. No.: 603,075

[22] Filed: Oct. 25, 1990

[51] Int. Cl.[5] ..... C11C 3/06

[52] U.S. Cl. ..... 554/165

[58] Field of Search ..... 260/410.7

[56] References Cited

U.S. PATENT DOCUMENTS 4,623,488 11/1986 Takao ..... 260/410.7

4,675,132 6/1987 Stout et al. ..... 260/412

OTHER PUBLICATIONS

Stout, Virginia F. "Synthesis of Fish Oil Omega-3 Triglycerides." vol. 65, No. 4 (Apr. 1988), pp. 499.

Nilsson, W. B. "Fractionation of Menhaden Oil Ethyl Esters Using Supercritical Fluid $CO_2$." vol. 65, No. 1 (Jan. 1988), pp. 109-117.

Nilsson, W. B. "Supercritical Fluid Fractionation of Fish Oil Esters Using Incremental Pressure Programming and a Temperature Gradient." vol. 66, No. 11 (Nov. 1989), pp. 1596-1600.

*Primary Examiner*—Jose G. Dees

*Assistant Examiner*—Deborah D. Carr

*Attorney, Agent, or Firm*—Alber & Tockman; Diana M. Cox

[57] ABSTRACT

Glycerides containing methylene-interrupted polyunsaturated fatty acid moieties are prepared by reacting a lower alkyl ester of the corresponding polyunsaturated fatty acid or desired mixture of fatty acids with glycerol in the presence of alkoxide ion as the catalyst and removing the lower alcohol as it is formed, preferably at a pressure below atmospheric pressure. Triglycerides of omega-3 fatty acids, such as EPA and DHA, were prepared and triglycerides of mixed polyunsaturated and monounsaturated or short or medium chain fatty acids can also be prepared using that approach.

8 Claims, 1 Drawing Sheet

PROCESS FOR PREPARING TRIGLYCERIDES CONTAINING POLYUNSATURATED FATTY ACID MOIETIES

The present invention relates to a process for the synthesis of triglycerides containing at least one polyunsaturated fatty acid moiety. More specifically it relates to a process for preparing triglycerides wherein the polyunsaturated acid is a methylene-interrupted fatty acid.

BACKGROUND OF THE INVENTION

Fish oils comprise a complex mixture of fatty acid moieties, mostly straight chain with an even number of carbon atoms. The fatty acids, usually present as their glycerides, are either saturated or mono- or polyunsaturated. Unlike vegetable oils and fats from terrestrial animals, which contain mainly fatty acids having a maximum of eighteen carbons and two or three double bonds, fish and marine mammal oils contain substantial amounts of fatty acids having twenty or twenty-two carbons and four, five or six double bonds. Among the fatty acid moieties unique to fish oils are the following omega-3 compounds: 18:4, 20:4, 20:5, 22:5, and 22:6, as well as other methylene-interrupted polyunsaturated fatty acids, such as 16:4nl and 16:3n4, which are present in significant amounts in fish oils. The omega-3 designation means that the first double bond begins at the third carbon counting from the methyl end of the chain; the designation n3 has the same meaning. In the number: number designation, the first number indicates chain length and the second number indicates how many double bonds are present. For example, 18:4 indicates a straight chain fatty acid having eighteen carbon atoms and four methylene-interrupted double bonds.

As indicated in U.S. Pat. No. 4,623,488, fish and marine oils are now recognized to be of potential nutritional and pharmacological value because they contain substantial quantities of polyunsaturated acids and as indicated in the paper by Nilsson et. al., "Fractionation of Menhaden Oil Ethyl Esters Using Supercritical Fluid $CO_2$", Journal of the American Oil Chemists' Society, Vol. 65, No. 1, pages 109–117 (1988), clinical studies have noted a positive correlation between a diet high in fish oils containing polyunsaturated acids and a decreased risk of coronary and inflammatory diseases. Omega-3 all cis-5,8,11,14,17-eicosapentaenoic acid (EPA or 20:5n3) and all cis-4,7,10,13,16,19-docosahexaenoic acid (DHA or 22:6n3) in particular, and other polyunsaturated fatty acids having their double bonds in the methylene-interrupted cis-configuration, are thought to be the most beneficial.

Fish and fish oils are the major source of significant quantities of omega-3 eicosanoid precursors, such as EPA (shown below) and DHA.

$$\underset{1}{CH_3}\underset{2}{CH_2}\underset{3}{CH}{=}CHCH_2(CH{=}CHCH_2)_4(CH_2)_2COOH$$

EPA (or 20:5n3)

Fish oils should be contrasted with oils of vegetable origin which contain more saturated fatty acid and omega-6 fatty acid residues, sometimes implicated in the complex process that leads to cardiovascular disease.

Fish oils contain some eight or more omega-3 fatty acid residues and contain approximately 3–18% EPA and 3–25% DHA. The largest values for EPA and DHA are difficult to obtain consistently because the exact composition of a particular fish oil is quite variable depending on geographical location, season, sex, sexual maturity, and other factors. Even obtaining the same composition from the same species of fish is difficult. It is, therefore, highly desirable to provide omega-3 and other methyleneinterrupted polyunsaturated fatty acid containing substances having a high and reproducible content of specific individual methylene-interrupted fatty acid residues or combinations of methyleneinterrupted fatty acid residues, alone or with specific monoenoic or short/or medium-chain length fatty acids relatively free of saturated, monounsaturated and n6 polyunsaturated acid residues, which at best add unnecessary calories and at worst may cause deleterious effects.

Since polyunsaturated free fatty acids autoxidize rapidly, individual polyunsaturated fatty acids, such as omega-3 fatty acids, or mixtures thereof are available and are utilized as their methyl or ethyl esters. However, the suitability of the ester form as a dietary supplement has been questioned. An obvious alternative to using such lower alkyl esters is a triglyceride containing only the desired methylene-interrupted fatty acids, such as tri-EPA (trieicosapentaenoylglylcerol) or tri-DHA (tridocosahexaenoylglycerol) or a triglyceride having a high content of such omega-3 fatty acids.

Saturated fatty acids and their esters react readily to form triglycerides. Long-chain polyunsaturated acids and esters behave differently and are remarkably resistant to interesterification, especially in the final step of going from the diglyceride to the fully esterified triglyceride. It appears that the conformation of hydrocarbyl chains containing four, five, or six methylene-interrupted double bonds sterically hinders approach of the carboxyl group to the third hydroxyl group, and methods suitable for the synthesis of triglycerides from saturated fatty acids are in general unsuitable for the synthesis of glycerides from such polyunsaturated fatty acids.

It is known from the prior art that omega-3 triglycerides can be prepared by reacting glycerol with free fatty acids a elevated temperatures. However, polyunsaturated fatty acids are very susceptible to attack by oxygen at such elevated temperatures, and oxidation destroys the very structure that is believed responsible for the beneficial properties of omega-3 fatty acids while producing by-products which may be toxic.

SUMMARY OF THE PRESENT INVENTION

The present invention provides an improved method for the synthesis of triglycerides containing a methylene-interrupted fatty acid residue by the reaction of esters of such fatty acids with glycerol. More specifically, the present invention is a method for the preparation of triglycerides containing a methylene-interrupted fatty acid residue which comprises reacting a lower alkyl ester of a methylene-interrupted fatty acid with glycerol in the presence of alkoxide ion while removing the lower alkanol formed during the course of the reaction.

Superior results are obtained when the lower alkanol or alcohol formed during the reaction is removed under vacuum, particularly at a pressure of 25 mm of Hg or lower, and when less than stoichiometric amounts of the lower alkyl ester of the omega-3 polyunsaturated acid, relative to glycerol, are utilized at a pressure of 1 mm of Hg or lower.

DETAILED DESCRIPTION OF THE INVENTION

Figure 1:
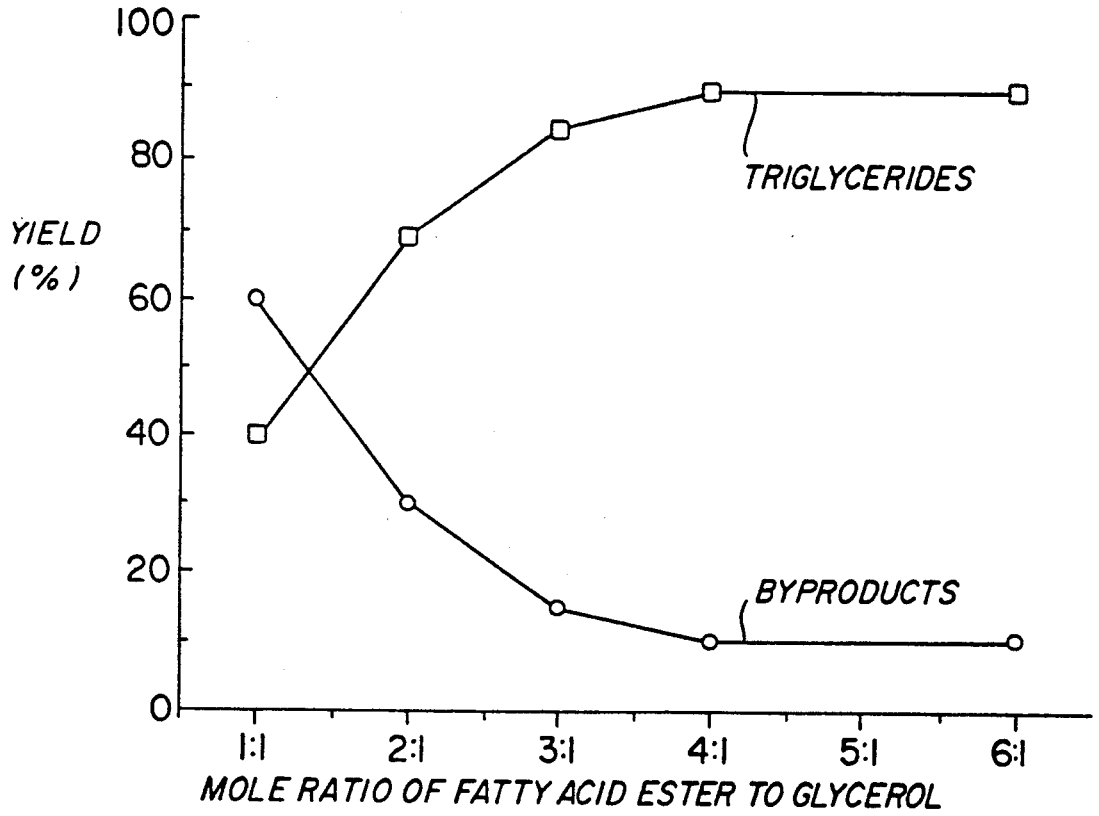
FIG. 1 is a graph illustrating the yield of triglycerides obtained when the initial mole ratio of fatty acid esters to glycerol is varied.

Alcoholysis of a triglyceride can be represented by the following equation:

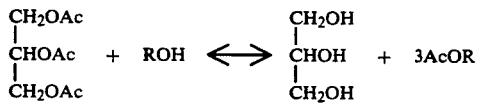

wherein Ac represents an acyl radical derived from the same or different fatty acids and ROH is an alcohol such as ethyl alcohol. Although the alcoholysis of triglycerides has long been known to be reversible, it is only recently that the applicability of the reverse reaction to the synthesis of triglycerides of omega-3 polyunsaturated acids has been recognized, Stout et. al. "Synthesis of Fish Oil Omega-3 Triglycerides," *Journal of the American Oil Chemists' Society,* Vol. 65, No. 4,499,500 (1988).

Lower alkyl omega-3 polyunsaturated fatty acid carboxylates used as reactants in the method of the present invention can be prepared by the procedures described in the paper by Nilsson et. al., "Supercritical Fluid Fractionation of Fish Oil Esters Using Incremental Pressure Programming and a Temperature Gradient", Journal of the American Oil Chemists' Society, Vol, 66, No. 11, pages 1596–1600 (1989) and in U.S. Pat. No. 4,675,132, the disclosure of which is incorporated herein by reference. The catalyst is alkoxide ion, preferably formed in situ from metallic sodium commercially available as such or as a 40% dispersion of sodium in mineral oil. Other sources of alkoxide ion include anhydrous metallic alkoxides, such as lithium, potassium and sodium methoxide and ethoxide, as well as by the reaction of metals such as magnesium and aluminum, which react spontaneously or readily with alcohols to form the corresponding alkoxide. The exact amount of alkoxide present is not critical. Preferred alkoxides are the alkoxides corresponding to lower alkyl carboxylate reactants; lower alkyl alkoxides and lower alkyl carboxylates wherein the alkyl group has 1–4 carbon atoms are preferred. Particularly preferred are the alkoxides and esters of the more volatile alcohols such as methanol, ethanol and isopropanol. This is the case because the alcoholysis reaction shown above is an equilibrium reaction and will be driven toward the left or in the reverse direction (toward formation of triglyceride) by removal of alcohol as it is formed. Removal of the alcohol is accomplished most readily by operation at a reduced pressure, preferably below 25 mm of Hg.

The process of the present invention may be effected at temperatures ranging from ambient (about 25° C.) up to about 175° C., With temperatures in the range of 75°–100° C. being preferred.

It is to be expected and it was initially believed that use of excess lower alkyl fatty acid ester, relative to glycerol, would drive the reaction in the desired direction, and in Examples 1–3 below more than two moles of ester were used for each mole of hydroxyl group in the glycerol reactant. However, this is less than desirable because, even though the excess esters can be recovered by supercritical fluid carbon dioxide extraction, the initial ester reactants are not easily obtained and are readily destroyed by autoxidation.

It was discovered that the yield of triglycerides could be increased, in terms of the amount of triglycerides produced from a specific amount of fatty acid esters, by starting with less than equivalent amounts of the ester reactant, relative to glycerol, while at the same time effecting the reaction at a pressure of 1 millimeter or less. This discovery, illustrated in Example 4–7, where less than 3 moles of ester are used per mole of glycerol, was surprising since one skilled in the art would expect that decreasing the amount of ester relative to glycerol would result in the formation of more monoglycerides and diglycerides and less triglycerides.

Methyl and ethyl esters of omega-3 polyunsaturated fatty acids are the preferred esters for practicing the method of the present invention, because they are more readily available and the volatility of methanol and ethanol expedites removal of those alcohols from the reaction system and drives the reaction more rapidly in the desired direction. Glycerol, while not particularly volatile, has a finite vapor pressure under the conditions of the reaction and would also be removed at pressures of 1 mm of Hg or less. A condenser maintained at temperatures of about 25°–75° C. may be located above the reaction vessel to prevent loss of glycerol.

Our invention is further illustrated by mean of the following non-limiting examples:

EXAMPLE 1

A concentrate of omega-3 polyunsaturated fatty acid esters containing 48.8% EPA and 22.9% DHA residues (No. 163 in Table 1) (10.005 g, 0.0305 mole, 6.76 moles per mole glycerol), anhydrous glycerol (0.415 g, 0.00451 mole), and sodium dispersion (0.09 g, 0.00157 mole, 0.116 mole per glycerol hydroxyl group) were combined in a round-bottom flask. The flask was evacuated to below 25 mm of Hg and flushed with nitrogen four times before heating. Using a sand bath, the mixture was heated at 70° C. for 22.5 hr. When cool, the reaction mixture was treated with $H_2O$ and $CH_2Cl_2$. The $CH_2Cl_2$ layer was acidified with dilute HCl, washed with $H_2O$ until the pH reached about 5, dried over anhydrous sodium sulfate and evaporated on a rotary evaporator to give 6.57 g of amber liquid. Thin-layer chromatography (TLC) on a silica gel plate developed in hexane/diethyl ether/acetic acid (80:20:1, v/v/v) indicated that the crude product contained 60% unreacted ester and 40% triglyceride, i.e., 2.63 g, representing a 62% yield of the triglyceride. To isolate more of the triglyceride, the original aqueous extract of the reaction mixture was acidified and extracted again with $CH_2Cl_2$. In this way, a second amber liquid was obtained, 1.82 g. By TLC this material was 30% triglyceride, i.e., 0.55 g, representing another 13% yield of the triglyceride. The overall yield was thus 75%, based on the amount of glycerol used.

Preparative TLC was used to separate the triglyceride from unreacted starting ester. The fatty acid profile of the triglyceride contained 47.9% EPA and 25.4% DHA fatty acid residues.

EXAMPLE 2

An ethyl ester mixture containing 24.9% 18:4n3(all cis-6,9,12,15-octadecatetraenoic or stearidonic acid) and 42.0% EPA (No. 174 in Table 1) (10.008 g, 0.0319 mole, 7.27 moles per mole glycerol), anhydrous glycerol (0.404 g, 0.00439 mole), and sodium dispersion (0.105 g, 0.00183 mole, 0.139 mole per hydroxyl group) were combined in a round-bottom flask. The flask was evacuated and heated to 74°-82° C. for 22.5 hr. Work up as in Example 1 yielded 16:3n4, 16:4nl, 18:4n3 and 20:5n3 mixed n3 (or omega-3) triglycerides.

EXAMPLE 3

An ethyl ester mixture containing 46.3% EPA, 2.6% 21:5n3, and 44.6% DHA fatty acid residues (No. 177 in Table 1) (10.015 g, 0.0292 mole, 6.38 moles per mole glycerol), anhydrous glycerol (0.422 g, 0.00458 mole), and sodium dispersion (0.115 g, 0.002 mole, 0.146 mole per hydroxyl group) were combined in a round-bottom flask. The flask was evacuated and heated to 76°-81° C. for 22 hr. Work up as in Example 1 yielded 9.37 g crude reaction mixture containing 20:5n3 and 21:5n3 and 22:6n3 mixed triglycerides.

EXAMPLE 4

A concentrate of n3 ethyl esters containing 23.1% 18:4n3 and 23.0% EPA (No. 217 in Table 1) (2.254 g, 2 moles ester per mole glycerol), anhydrous glycerol (0.271 g, 0.00294 mole), and sodium dispersion (0.062 g, 0.00108 mole) were combined in a round-bottom flask. The flask was evacuated and flushed with nitrogen four times before the evacuated flask was heated in a silicon oil bath. After the bath temperature reached 85°-98° C., the pressure was reduced to 0.7 mm of Hg. The pressure fell gradually to 0.4-0.5 mm of Hg as the mixture was heated for 19.5 hr. Work-up as described in Example 1 gave 2.12 g product. TLC showed the mixture to be predominantly triglycerides (80-85%) as well as free fatty acids together with diglycerides (10%), and monoglycerides (5%); no spot was seen at the $R_f$ corresponding to the ester reactant.

The procedure of this example is readily adaptable to larger scale syntheses of omega-3 triglycerides, including the preparation of triglycerides from individual omega-3 polyunsaturated fatty acid esters, such as EPA and DHA.

EXAMPLE 5

A concentrate of EPA ethyl ester containing 90.08% EPA residues (No. 222 in Table 1) (50.15 g, 0.152 mole, 2.32 moles ester per mole glycerol), anhydrous glycerol (6.04 g, 0.0656 mole), and sodium dispersion (1.07 g, 0.019 mole, 0.0965 mole per hydroxyl group) were combined in a round-bottom flask. The flask was evacuated and flushed with nitrogen three times and evacuated to below 2 mm of Hg before heating in a silicon oil bath. The bath temperature slowly rose to 100° C., after 1.5 hr. At 2 hr, the pressure had fallen to 1.3 mm and the temperature was 97.5° C. The pressure fell to 0.7 mm at 21 hr. Work-up as described above gave 49.21 g product. TLC showed the mixture to be predominantly triglycerides (about 60%) together with about 12% starting esters, about 18% diglycerides, about 5% free fatty acids and about 5% unidentified byproducts.

EXAMPLE 6

A concentrate of DHA ethyl ester containing 89.5% DHA residues (No. 224 in Table 1) (50.28 g, 0.141 mole, 2.39 moles ester per mole glycerol), anhydrous glycerol (5.43 g, 0.0590 mole), and sodium dispersion (1.17 g, 0.020 mole, 0.115 mole per hydroxyl group) were combined in a round-bottom flask. The flask was evacuated and flushed with nitrogen several times and evacuated to 1 mm before heating in a silicon oil bath. The bath temperature slowly rose to 100° C. after about 15 min and then was held at 85°-90° C. for about 2 hr. After 6 hr, the pressure had dropped to 0.55 mm of Hg and the temperature was 93° C. Heating was increased slightly after 11 hr, and the temperature was held at 98°-101° C. until the total reaction time was 21.75 hr. Work-up as described in Example 1 gave 50.11 g of an orange product. TLC showed the mixture to be predominantly triglycerides (about 70%) together with about 2-5% starting esters, about 15-20% diglycerides, about 5% free fatty acids and about 5% unidentified byproduct.

TABLE 1

FATTY ACID CONTENT OF OMEGA-3 FATTY ACID ESTER REACTANTS USED IN EXAMPLES 1-6

| | Mixture No. | | | | | |
|---|---|---|---|---|---|---|
| Fatty Acid | 163 | 174 | 177 | 217 | 222 | 224 |
| 16:3n4 | — | 7.4 | — | 19.4 | — | — |
| 16:4n1 | — | 8.5 | — | 13.0 | — | — |
| 18:4n3 | — | 24.9 | — | 23.1 | 2.01 | — |
| 20:4n3 | 0.3 | 0.2 | 0.5 | 0.1 | 0.31 | — |
| 20:5n3 | 48.8 | 42.0 | 46.3 | 23.0 | 90.08 | 2.7 |
| 21:5n3 | — | — | 2.6 | — | 0.99 | 1.3 |
| 22:6n3 | 22.9 | 1.7 | 44.6 | 0.1 | 3.31 | 89.5 |

EXAMPLE 7

The mole ratio of ester to glycerol was varied as follows: 6:1, 4:1, 3:1 in duplicate at 95.5/99.5° C., 3:1 at 10° lower (85.5/89.5° C.), 2.5:1, 2:1, 1:1, and 1:0. The ester selected was 90% EPA in order to simplify examination of the reaction mixture, and each experiment used the same amount of EPA (14g); the amount of glycerol was adjusted to provide the desired mole ratio. In each case, the amount of Na was dependent on the amount of glycerol, namely, 0.206 g Na dispersion per gram of glycerol. The three reagents were combined and the flask evacuated at room temperature until bubbling subsided. Then the mixture was heated with stirring for about 4 hours at 95.5° C. and at 99.5° C. for another 19 hours. Over the course of the reaction, the pressure in the vessel fell from about 0.27-0.34 torr to about 0.12-0.14 torr. Workup gave the crude product as an amber oil. The yield of triglyceride, estimated by thin-layer chromatography, is shown in FIG. 1. As can be seen, the yield of triglycerides is dependent on the initial mole ratio of ester to glycerol, but is a surprising 40% at a mole ratio of 1:1. At a mole ratio of 4:1, the yield of triglyceride levels off at about 90%.

Since the reaction of a fatty acid ester and glycerol to form a triglyceride is an equilibrium process that proceeds through the intermediate mono- and diglycerides, one might assume that less than stoichiometric amounts of ester would lead to increased proportions of those intermediates. Thin-layer chromatography does show that the intermediates are present in larger proportions when less than stoichiometric amounts of ester, i.e., less than three moles ester per mole of glycerol, are used. Surprisingly it was discovered that at one mole ester per mole glycerol the triglyceride is present in 40% yield and at two moles in 70% yield; and the yield of triglyceride reaches a plateau at four moles ester per mole glycerol. The importance of this discovery is that it provides a method for preparing triglycerides which utilizes lesser amounts of the difficult-to-obtain and costly omega-3 or other polyunsaturated ester needed for the synthesis of highly desirable triglycerides.

The method of the present invention can be used to prepare a mixed triglyceride containing an omega-3 or other polyunsaturated fatty acid residue and monoenoic or shorter-chain saturated fatty acid residues. Such triglycerides are useful because they are a source of polysaturated fatty acids and may be more stable and resistant to oxidation than triglycerides wherein all of the fatty acids are polyunsaturated. Short- and medium-chain-length fatty acid containing triglycerides have different intestinal absorptive properties than triglycerides wherein all of the fatty acid residues are polyunsaturated. Thus, triglycerides formed from short- (2 to 7 carbon-containing), medium- (8 to 15 carbon) chain, and/or monoenoic fatty acids in combination with polyunsaturated fatty acids from fish oils may be more stable and may be more effectively adsorbed.

What is claimed is:

1. A method for the preparation of a triglyceride containing at least one polyunsaturated fatty acid residue which comprises reacting less than three moles of polyunsaturated fatty acid $C_{1-4}$ alkyl esters with one mole of glycerol in the presence of a $C_1$–$C_4$ alkoxide of lithium, potassium, sodium, magnesium or aluminum, at a temperature of about 25°–175° C. and at a pressure below atmospheric pressure; and separating $C_{1-4}$ alkanol as it is formed.

2. A method according to claim 1, wherein the temperature is about 75°–100° C.

3. The method according to claim 1, wherein two moles of the ester are reacted with one mole of glycerol.

4. The method of claim 1, wherein the pressure is below about 25 mm of Hg.

5. The method of claim 4, wherein the pressure is below about 1 mm of Hg.

6. A method according to claim 1, wherein the polyunsaturated fatty acid is a methylene-interrupted fatty acid.

7. A method according to claim 6, wherein the methylene-interrupted fatty acid is an omega-3 acid.

8. A method according to claim 7, wherein the omega-3 acid is EPA or DHA.

* * * * *